US006220260B1

(12) United States Patent
Sachs

(10) Patent No.: US 6,220,260 B1
(45) Date of Patent: Apr. 24, 2001

(54) SUNSHADE DEVICE

(75) Inventor: Robert Sachs, Jia Yi (TW)

(73) Assignee: Chen-Hsiung Lin, Jia Yi Hsien (TW)

( * ) Notice: Subject to any disclaimer, the term of this patent is extended or adjusted under 35 U.S.C. 154(b) by 0 days.

(21) Appl. No.: 09/425,348

(22) Filed: Oct. 22, 1999

(51) Int. Cl.[7] ..... A45B 3/00
(52) U.S. Cl. ..... 135/15.1
(58) Field of Search ..... 135/16, 77, 66, 135/70, 79, 80, 81; 248/150, 156, 545, 530

(56) References Cited

U.S. PATENT DOCUMENTS 787,237 * 4/1905 Turner ..... 135/16
2,103,948 * 12/1937 Jones ..... 135/15.1 X
4,850,564 * 7/1989 Padin ..... 248/156 X

FOREIGN PATENT DOCUMENTS

477182 * 9/1951 (CA) ..... 135/79
452583 * 11/1927 (DE) ..... 135/78
850535 * 12/1939 (FR) ..... 108/150
2075832 * 11/1981 (GB) ..... 135/15.1

* cited by examiner

*Primary Examiner*—Jose V. Chen
(74) *Attorney, Agent, or Firm*—Alan Kamrath; Rider Bennett Egan & Arundel, LLP.

(57) ABSTRACT

A sunshade device has a hollow shaft, a gore disposed on an upper end of the hollow shaft, and a lower end of the hollow shaft receiving a connection rod. The hollow shaft has two lower protrusions. The connection rod has an annular flange defining a first portion and a second portion. The first portion of the connection rod has a flat end and two generally L-shaped grooves. The second portion of the connection rod has a tip end and two generally L-shaped recesses.

12 Claims, 5 Drawing Sheets

SUNSHADE DEVICE

BACKGROUND OF THE INVENTION

The present invention relates to a sunshade device. More particularly, the present invention relates to a sunshade device which has a connection rod inserted in the ground or a tube.

Referring to FIG. 5, a conventional sunshade device has a solid shaft 21, a gore 2 disposed on an upper end of the solid shaft 21, and a lower end of the solid shaft 21 inserted in a tube 11 of a base seat 1. However, the base seat 1 should not be placed on soft soil or uneven ground. The conventional sunshade device will fall down under a strong wind.

SUMMARY OF THE INVENTION

An object of the present invention is to provide a sunshade device which has a connection rod to be inserted in the ground.

Another object of the present invention is to provide a sunshade device which has a connection rod to be inserted in a tube of a base seat.

In accordance with a first preferred embodiment of the present invention, a sunshade device comprises a hollow shaft, a gore disposed on an upper end of the hollow shaft, and a lower end of the hollow shaft receiving a connection rod. The hollow shaft has two lower protrusions. The connection rod has an annular flange defining a first portion and a second portion. The first portion of the connection rod has a flat end and two generally L-shaped grooves. The second portion of the connection rod has a tip end and two generally L-shaped recesses. The second portion of the connection rod is inserted in the lower end of the hollow shaft. The lower protrusions of the hollow shaft are inserted in the generally L-shaped recesses of the second portion of the connection rod.

In accordance with a second preferred embodiment of the present invention, a sunshade device comprises a hollow shaft, a gore disposed on an upper end of the hollow shaft, and a lower end of the hollow shaft receiving a connection rod. The hollow shaft has two lower protrusions. The connection rod has an annular flange defining a first portion and a second portion. The first portion of the connection rod has a flat end and two generally L-shaped grooves. The second portion of the connection rod has a tip end and two generally L-shaped recesses. The first portion of the connection rod is inserted in the lower end of the hollow shaft. The lower protrusions of the hollow shaft are inserted in the generally L-shaped grooves of the first portion of the connection rod.

DETAILED DESCRIPTION OF THE INVENTION

Figure 1:
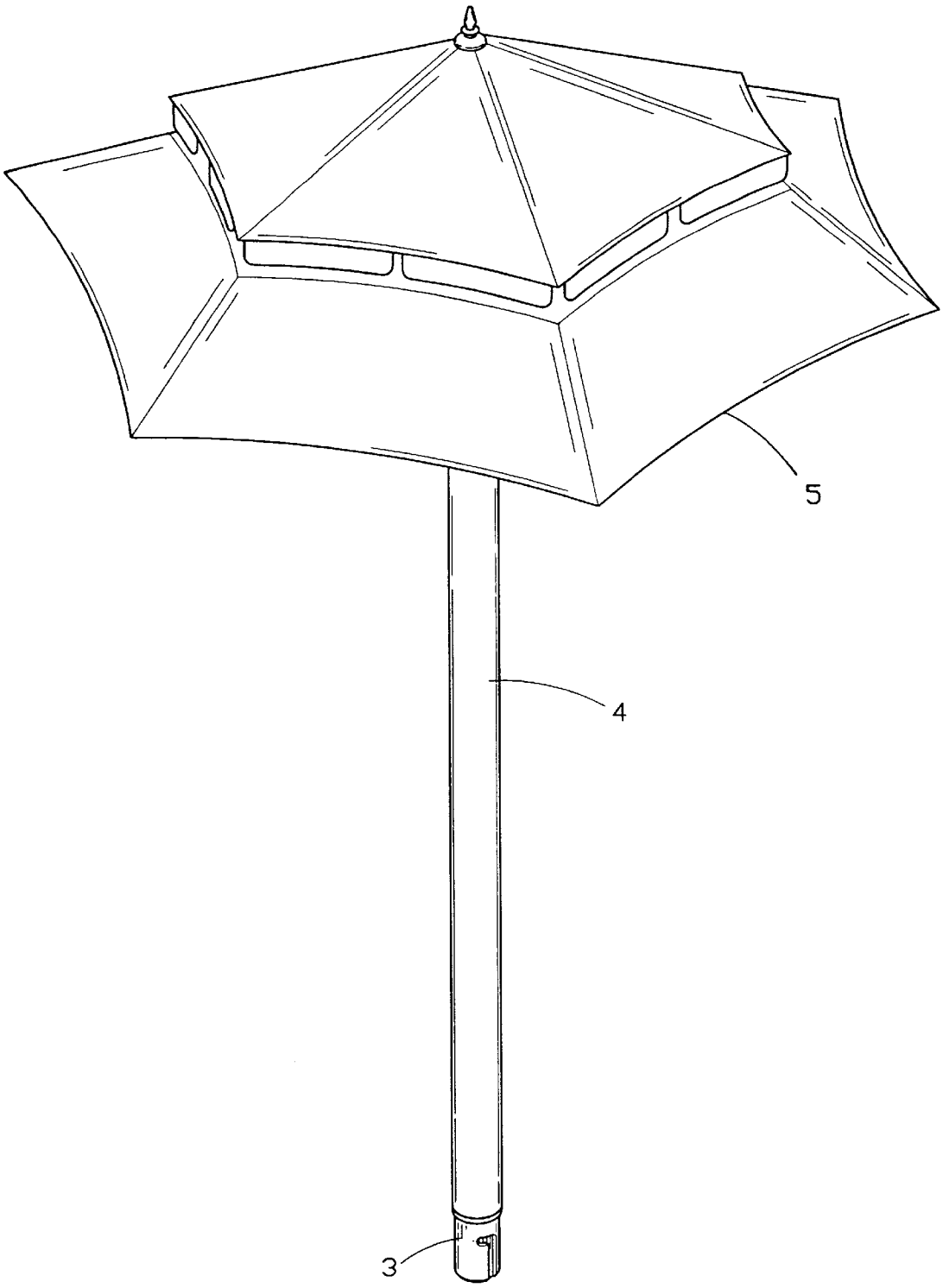
FIG. 1 is a perspective assembly view of a sunshade device of a preferred embodiment in accordance with the present invention.
Figure 2:
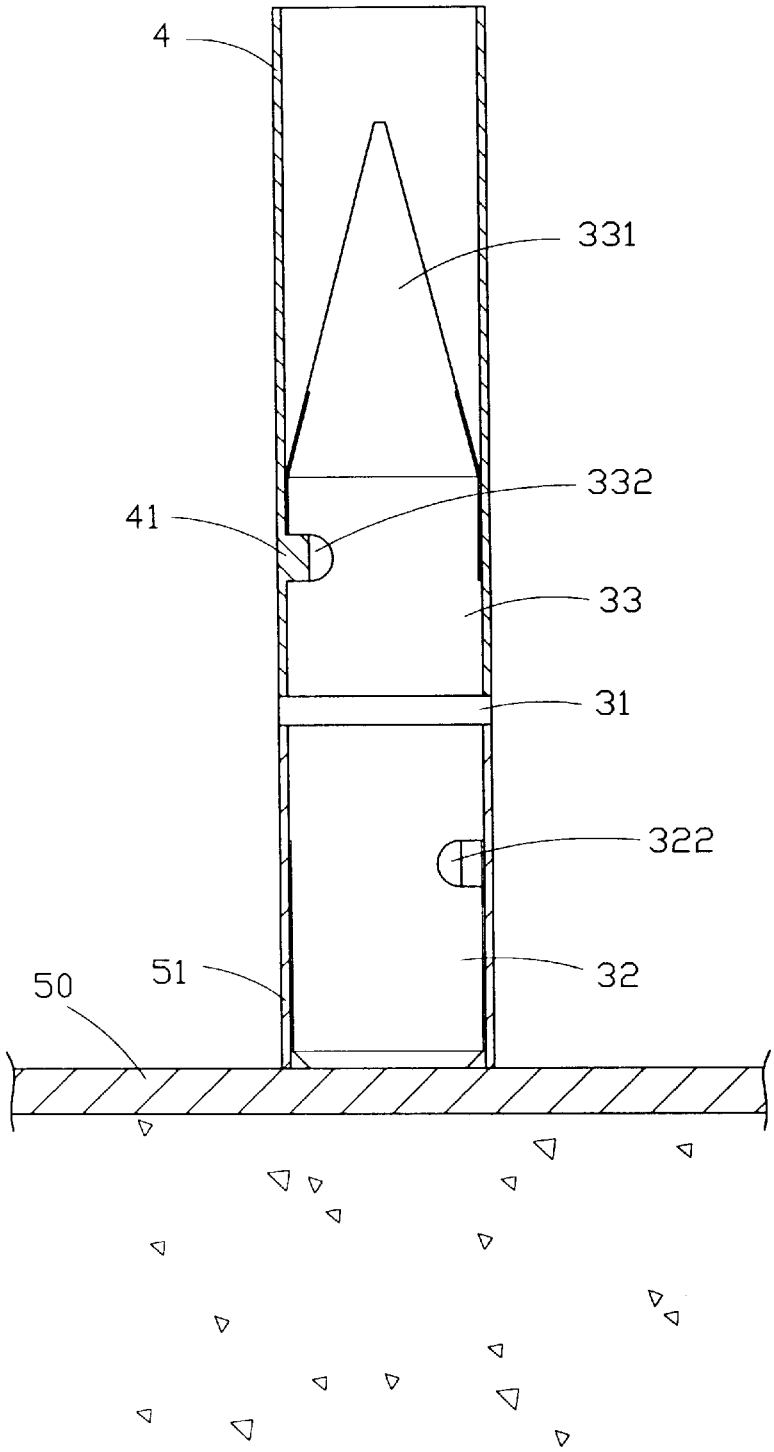
FIG. 2 is a sectional assembly view of a hollow shaft, a connection rod, a tube, and a base seat of a preferred embodiment in accordance with the present invention.
Figure 3:
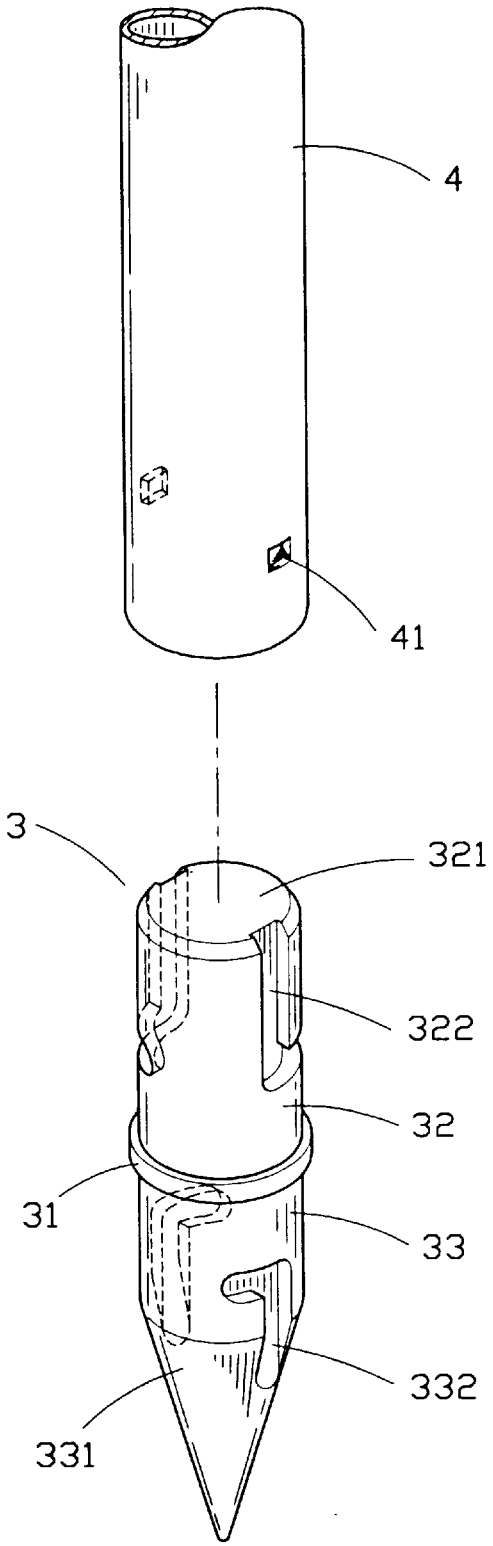
FIG. 3 is a perspective exploded view of a hollow shaft and a connection rod of a preferred embodiment in accordance with the present invention.

Referring to FIGS. 1 to 3, a sunshade device comprises a hollow shaft 4, a gore 5 disposed on an upper end of the hollow shaft 4, and a lower end of the hollow shaft 4 receiving a connection rod 3.

The hollow shaft 4 has two lower protrusions 41.

The connection rod 3 has an annular flange 31 defining a first portion 32 and a second portion 33. The first portion 32 of the connection rod 3 has a flat end 321 and two generally L-shaped grooves 322. The second portion 33 of the connection rod 3 has a tip end 331 and two generally L-shaped recesses 332.

Referring to FIGS. 1 and 2 again, the second portion 33 of the connection rod 3 is inserted in the lower end of the hollow shaft 4. The lower protrusions 41 of the hollow shaft 4 are inserted in the generally L-shaped recesses 332 of the second portion 33 of the connection rod 3.

The first portion 32 of the connection rod 3 is inserted in a tube 51 of a base seat 50.

Figure 4:
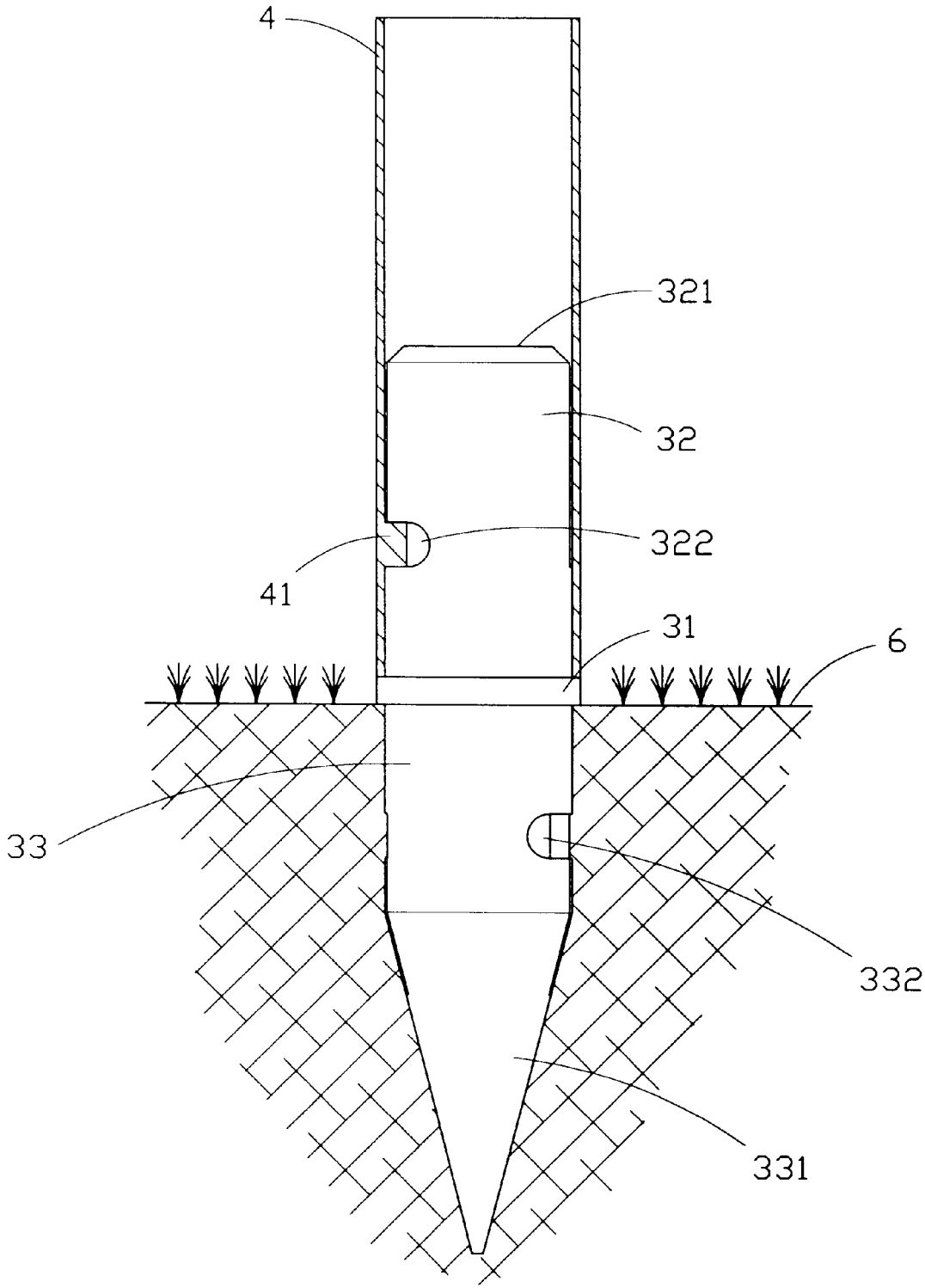
FIG. 4 is a sectional schematic view illustrating a tip end of a connection rod inserted in the ground.
Figure 5:
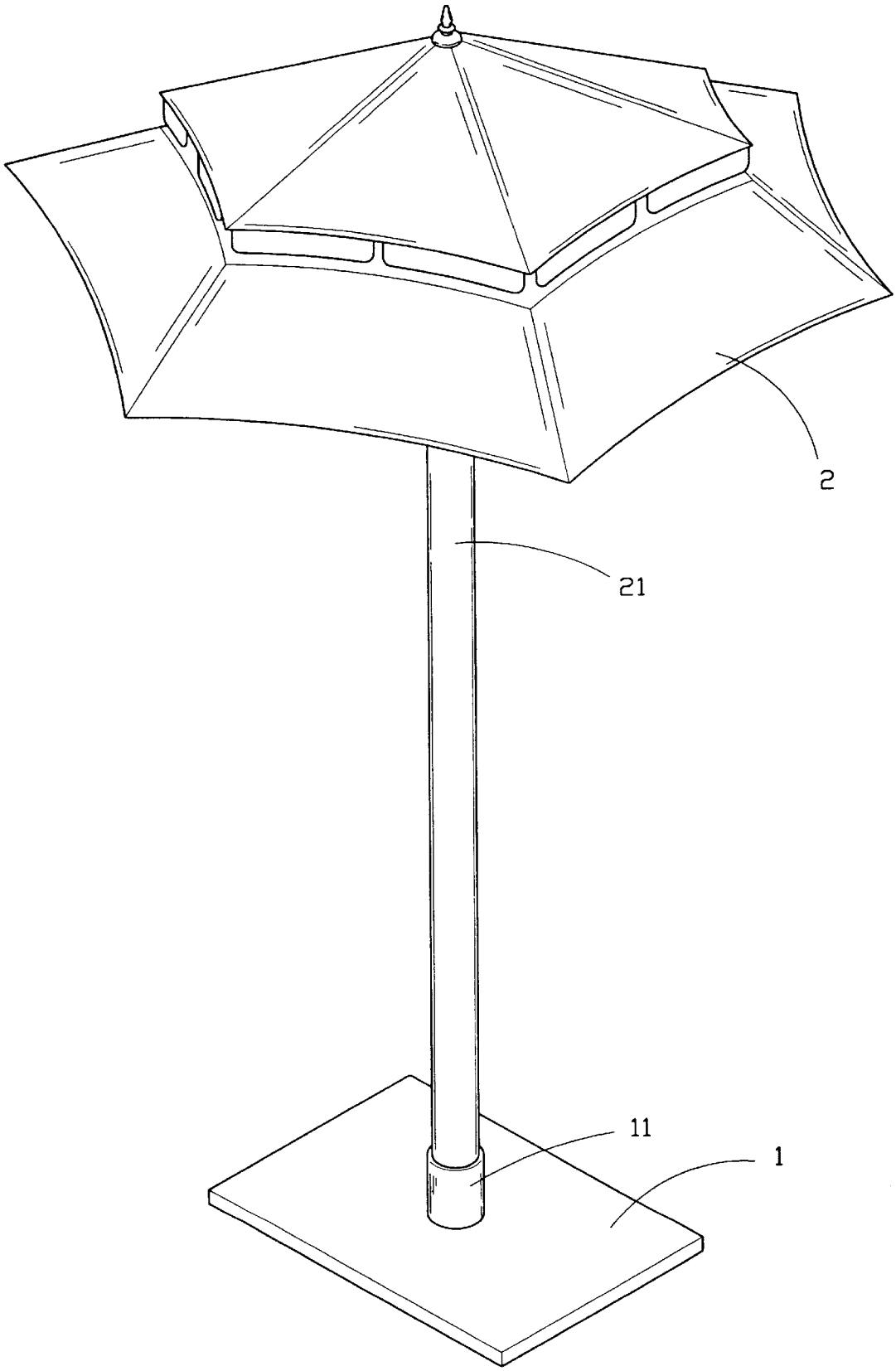
FIG. 5 PRIOR ART
FIG. 5 is a perspective view of a conventional sunshade device of the prior art.

Referring to FIGS. 3 and 4, the first portion 32 of the connection rod 3 is inserted in the lower end of the hollow shaft 4. The lower protrusions 41 of the hollow shaft 4 are inserted in the generally L-shaped grooves 322 of the first portion 32 of the connection rod 3.

The tip end 331 of the second portion 33 of the connection rod 3 is inserted in the ground 6.

The invention is not limited to the above embodiment but various modifications thereof may be made. Further, various changes in form and detail may be made without departing from the scope of the invention.

I claim:

1. A sunshade device comprising, in combination:

a hollow shaft, a gore disposed on an upper end of the hollow shaft, a lower end of the hollow shaft receiving a connection rod, the hollow shaft having two lower protrusions, and the connection rod having an annular flange defining a first portion and a second portion, the first portion of the connection rod having a flat end and two generally L-shaped grooves, with the two lower protrusions being removably insertable in the two generally L-shaped grooves when the first portion of the connection rod is inserted in the lower end of the hollow shaft, the second portion of the connection rod having a tip end and two generally L-shaped recesses, with the two lower protrusions of the hollow shaft being removably insertable in the two generally L-shaped recesses of the second portion of the connection rod when the second portion of the connection rod is inserted in the lower end of the hollow shaft.

2. The sunshade device of claim 1 further comprising, in combination: a base seat having a tube, with the first portion of the connection rod being insertable into the tube when the second portion of the connection rod is inserted in the lower end of the hollow shaft and the two lower protrusions of the hollow shaft are inserted in the two generally L-shaped recesses of the second portion of the connection rod.

3. The sunshade device of claim 2 wherein the tube of the base seat abuts with the annular flange of the connection rod when the second portion of the connection rod is inserted in the lower end of the hollow shaft and the two lower protrusions of the hollow shaft are inserted in the two generally L-shaped recesses of the second portion of the connection rod.

4. The sunshade device of claim 3 wherein the tube of the base seat and the annular flange have identical sized and shaped peripheries.

5. The sunshade device of claim 4 wherein the hollow shaft and the annular flange have identical sized and shaped peripheries.

6. The sunshade device of claim 5 wherein the lower end of the hollow shaft abuts with the annular flange of the connection rod when the second portion of the connection rod is inserted in the lower end of the hollow shaft and the two lower protrusions of the hollow shaft are inserted in the two generally L-shaped recesses of the second portion of the connection rod and when the first portion of the connection rod is inserted in the lower end of the hollow shaft and the two lower protrusions of the hollow shaft are inserted in the two generally L-shaped grooves of the first portion of the connection rod.

7. The sunshade device of claim 3 wherein the lower end of the hollow shaft abuts with the annular flange of the connection rod when the second portion of the connection rod is inserted in the lower end of the hollow shaft and the two lower protrusions of the hollow shaft are inserted in the two generally L-shaped recesses of the second portion of the connection rod and when the first portion of the connection rod is inserted in the lower end of the hollow shaft and the two lower protrusions of the hollow shaft are inserted in the two generally L-shaped grooves of the first portion of the connection rod.

8. The sunshade device of claim 1 wherein the hollow shaft and the annular flange have identical sized and shaped peripheries.

9. The sunshade device of claim 1 wherein the lower end of the hollow shaft abuts with the annular flange of the connection rod when the first portion of the connection rod is inserted in the lower end of the hollow shaft and the two lower protrusions of the hollow shaft are inserted in the two generally L-shaped grooves of the first portion of the connection rod.

10. The sunshade device of claim 9 wherein the hollow shaft and the annular flange have identical sized and shaped peripheries.

11. The sunshade device of claim 1 wherein the lower end of the hollow shaft abuts with the annular flange of the connection rod when the second portion of the connection rod is inserted in the lower end of the hollow shaft and the two lower protrusions of the hollow shaft are inserted in the two generally L-shaped recesses of the second portion of the connection rod.

12. The sunshade device of claim 11 wherein the hollow shaft and the annular flange have identical sized and shaped peripheries.

* * * * *